US006406345B2

(12) United States Patent
Boehler et al.

(10) Patent No.: US 6,406,345 B2
(45) Date of Patent: Jun. 18, 2002

(54) SPARK PLUG SHELL HAVING A BIMETALLIC GROUND ELECTRODE, SPARK PLUG INCORPORATING THE SHELL, AND METHOD OF MAKING SAME

(75) Inventors: Jeffrey T. Boehler, Holland; Gary B. Zulauf, Findlay, both of OH (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/960,687

(22) Filed: Sep. 21, 2001

Related U.S. Application Data

(62) Division of application No. 09/334,533, filed on Jun. 16, 1999, now Pat. No. 6,326,719.

(51) Int. Cl.[7] ..... H01T 21/02
(52) U.S. Cl. ..... 445/7; 228/165; 228/174
(58) Field of Search ..... 445/7; 228/165, 228/174

(56) References Cited

U.S. PATENT DOCUMENTS 4,744,119 A * 5/1988 Omori ..... 470/24
4,810,220 A * 3/1989 Moore ..... 445/7
5,210,457 A * 5/1993 Oshima et al. ..... 313/11.5
5,395,273 A * 3/1995 Matsutani ..... 219/121.64
5,456,624 A * 10/1995 Moore et al. ..... 219/93
5,530,313 A * 6/1996 Chiu ..... 219/78.01
5,675,209 A * 10/1997 Hall et al. ..... 313/131 A
5,743,777 A * 4/1998 Demeuter ..... 313/11.5
5,866,973 A * 2/1999 Kagawa et al.

* cited by examiner

*Primary Examiner*—Kenneth J. Ramsey

(57) ABSTRACT

A spark plug includes a metal shell, an insulator coaxially disposed within the metal shell, and a center electrode coaxially disposed in the insulator. The metal shell has a substantially cylindrical base portion, and the base portion has a lower surface with a recess formed therein. A bimetallic ground electrode is affixed to the lower surface of the base portion at the recess thereof. The ground electrode has a central core formed of a first thermally conductive metal which may include copper, and an external sheath surrounding the core, the sheath being made of a second metal which includes nickel. The recess in the lower surface of the metal shell is preferred to be provided as an annular grove extending therearound. The present invention also encompasses a method of making a spark plug, including a step of placing a ground electrode adjacent a lower surface of a spark plug shell, aligned with a recess thereof, such that a tip end of the ground electrode enters into the recess. Another step in the method involves welding the ground electrode to the spark plug shell.

6 Claims, 3 Drawing Sheets

SPARK PLUG SHELL HAVING A BIMETALLIC GROUND ELECTRODE, SPARK PLUG INCORPORATING THE SHELL, AND METHOD OF MAKING SAME

This is a divisional of U.S. application Ser. No. 09/334,533, filed Jun. 16, 1999 now U.S. Pat. No. 6,326,719.

BACKGROUND OF THE INVENTION

1. Field of the Invention

The present invention relates to spark plugs for internal combustion engines, and to a method of making such spark plugs. More particularly, the present invention relates to a spark plug having a bimetallic ground electrode, and to a method of making such a spark plug.

2. Description of the Background Art

Spark plugs are widely used to ignite fuel in internal combustion engines. Spark plug electrodes are subject to intense heat, and to a highly corrosive environment, generated by the exploding air/fuel mixture. To improve durability and erosion resistance, spark plug electrodes must be able to withstand the high temperature and corrosive environment resulting from the chemical reaction products between air, fuel, fuel additives, and recirculated exhaust gases within a combustion chamber.

Spark plug designs have been suggested in which a bimetallic ground electrode includes a central core material, usually including copper, and a surrounding cladding material which is different from the central core material. This central core material is more thermally conductive than the surrounding cladding, and therefore conducts heat away from the firing tip of the ground electrode better than the previous designs. A cooler ground electrode is preferable because it does not erode as quickly as a hotter electrode. As a result, a cooler electrode contributes to a longer useful spark plug life.

Illustrative examples of this type of spark plug design may be found in U.S. Pat. Nos. 4,970,426, 5,210,457, 5,395,273, 5,530,313, 5,551,902, 5,675,209 and 5,866,973.

Although this type of design for bimetallic ground electrodes helps to ensure both thermal and electrical conductivity therethrough, a problem exists with this type of design, because the material making up the central core does not usually bond well, in a welding process, to the main spark plug shell, which is normally made of a ferrous material such as steel. The outer cladding material tends to weld to the steel shell better than the central core material.

Some efforts have been rut forward to try and improve the weld between the ground electrode and the shell. U.S. Pat. No. 5,530,313 to Chiu discloses a method of welding a copper cored ground electrode to a metal spark plug shell, in which a metal sheath of the ground electrode surrounds a copper core, and in which the metal sheath penetrates deeper into the metal shell than the copper core to provide an anchor therefor. An electrode 116 which has a metal sheath 119 extending beyond a central copper core 117 is shown in FIG. 3 of the present specification. In attaching a prior art ground electrode, such as the electrode 116 shown in FIG. 3, to a flat surface of a shell base 115, the area of contact between the electrode sheath 119 and the shell base is still somewhat limited.

A need still exists in the art for an improved design for a spark plug having a bimetallic ground electrode, in which the welded connection between the ground electrode and the shell is further enhanced and improved.

SUMMARY OF THE INVENTION

The present invention provides an improved spark plug for use with internal combustion engines. In the spark plug hereof, improved bonding is obtained between a bimetallic ground electrode and a spark plug shell having a recess formed therein to receive a tip end of the ground electrode.

A spark plug according to the invention includes a metal shell, an insulator coaxially disposed within the metal shell, and a center electrode coaxially disposed in the insulator. The metal shell has a base portion, and the base portion has a lower surface with a recess formed therein. The recess in the lower surface of the metal shell is preferred to be a substantially continuous annular grove extending around the lower surface.

A bimetallic ground electrode is affixed to the lower surface of the spark plug shell base, at the recess thereof. The ground electrode has a central core formed of a first thermally conductive metal, which preferably includes copper. The ground electrode also has an external sheath surrounding the core, the sheath being made of a second metal which includes nickel.

The present invention also encompasses a method of making a spark plug, including a first step of providing a metal shell with a cylindrical base portion, in which the base portion includes a lower surface with a recess formed therein. The method also includes a step of providing a ground electrode having a central core formed from a thermally conductive material.

The method also includes a further step of placing a tip end of the ground electrode adjacent the lower surface of the shell and aligned with the recess thereof, such that part of the tip end of the ground electrode enters into the recess. Another step in the method involves welding the ground electrode to the spark plug shell.

Accordingly, it is an object of the present invention to provide a spark plug having a bimetallic ground electrode with improved adhesion between the ground electrode and the spark plug shell.

It is a further object of the present invention to provide a spark plug having a bimetallic ground electrode in which an area of contact, between the ground electrode and the spark plug shell, is increased above the area of contact therebetween in the previously known designs.

It is yet a further object of the present invention to provide a method of making the preferred spark plug.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Overview

Figure 1:
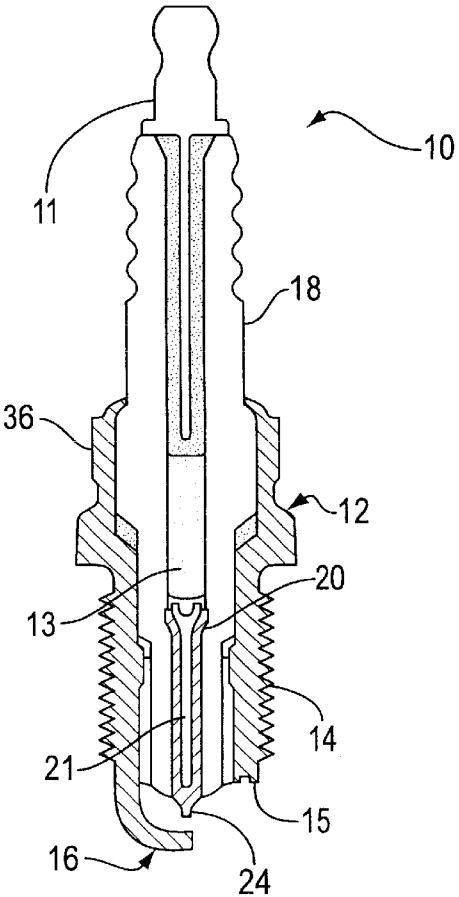
FIG. 1 is a cross-section of a spark plug in accordance with a first embodiment of the present invention.

Referring now to the drawings, and particularly to FIG. 1, a spark plug in accordance with the present invention is shown generally at 10. The spark plug 10 includes a metal casing or shell 12 having an externally threaded cylindrical base 14 for threadable engagement in a cylinder head (not shown).

A bimetallic ground electrode 16 is welded on to the lower surface 15 of the threaded base 14.

The spark plug 10 further includes a ceramic insulator 18 disposed concentrically within the shell 12, and a center electrode 20 disposed concentrically within the insulator 18. The center electrode 20 is preferred to include a central core 21 made of a thermally conductive material such as copper or a copper alloy. An electrically conductive insert or rod 11 fits into the upper end of the insulator 18 opposite the center electrode 20, and a refractory glass-carbon composite material is disposed between the lower end of the insert 11 and the center electrode, to provide an internal resistor 13 within the spark plug 10.

Figure 2:
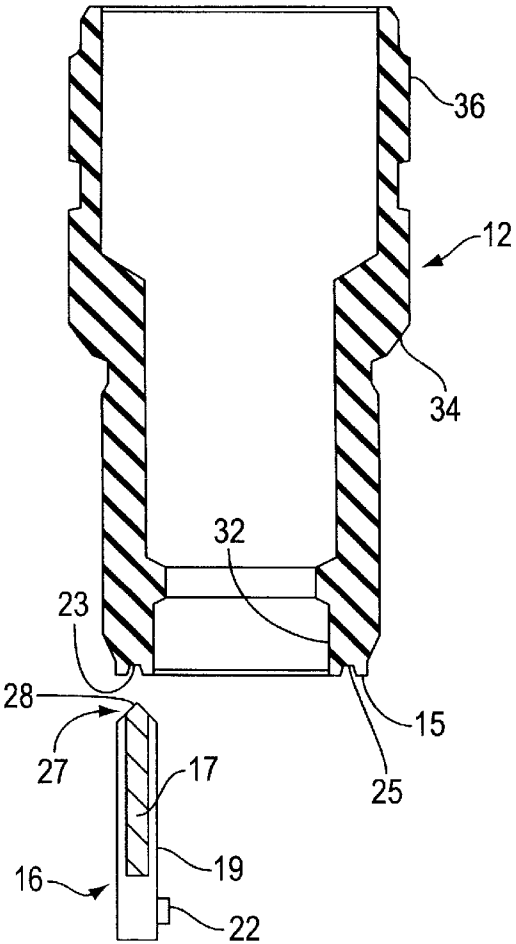
FIG. 2 is a cross-sectional detail of a spark plug shell and a bimetallic ground electrode for a different spark plug application than that shown in FIG. 1, immediately prior to welding of the electrode to the shell in accordance with the invention.

Although the metal shell 12 shown as a component of the spark plug 10 is physically different from the shell 12 shown in FIG. 2, these differences go primarily to different sealing surfaces. The respective spark plug shells 12 of FIGS. 1 and 2 are included as illustrative examples of the invention, and are simply configured for alignment thereof in different applications, as is well known in the art. The different physical configurations of the spark plug shells 12 do not substantially affect the shell for purposes of the present invention. Accordingly, both of these shells will be referred to generically and interchangeably, throughout the present specification, with the same reference number 12. Other modified configurations of spark plug shells are also compatible with the present invention.

As used throughout the present specification, the terms "upper", "lower" and similar relative terms are used to refer to the orientation of the spark plug shell 12 and other parts of the spark plug 10 in the orientation shown in FIGS. 1–2. It will be understood that the spark plug may be inverted or placed on its side, and that in some applications, spark plugs are installed in a different orientation from that shown in FIGS. 1–2. Accordingly, these terms are not intended to be absolute, but rather, to relate to, and to illustrate specific examples of the invention.

The Ground Electrode

The ground electrode 16 according to the invention includes a central core 17 (FIGS. 2, 4) formed from a first metal which is thermally conductive. The ground electrode 16 further includes an exterior sheath 19 surrounding the central core. The material of the central core 17 is preferred to contain copper, silver, an alloy containing copper and/or silver, or another metal having higher thermal conductivity than that of the surrounding sheath 19. The sheath 19 is preferred to be made of a nickel alloy. Suitable nickel alloys for the sheath are well known in the art.

The most preferred ground electrode 16 for use in accordance with the present invention is one made in accordance with the teachings of co-pending patent application Ser. No. 09/228,450, filed Jan. 11, 1999, the disclosure of which is hereby incorporated by reference. However, other bimetallic ground electrodes, having central thermally conductive cores therein and consistent with the present specification, may be used in the practice of the present invention.

By way of illustration and not limitation, one suitable example of a ground electrode 16 in accordance with the invention might be 1.2 mm in diameter, and out of that, 0.6 mm could be the central core 17, with an outer cladding 19 of 0.3 mm on each side of the core.

Figure 4:
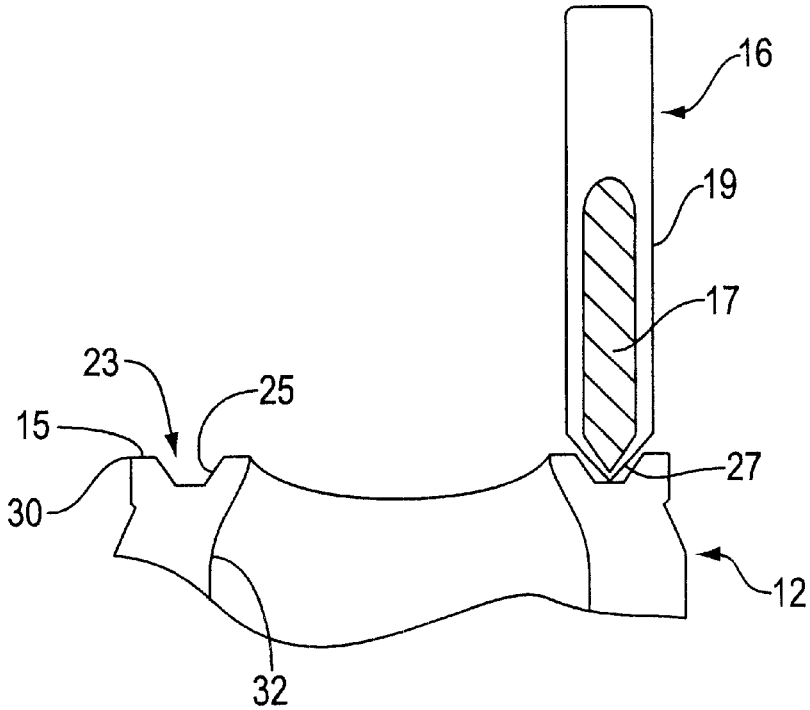
FIG. 4 is a cross-sectional detail view, partially broken away, of a spark plug shell and electrode therefor in accordance with the present invention, before attachment of the electrode to the shell.
Figure 5:
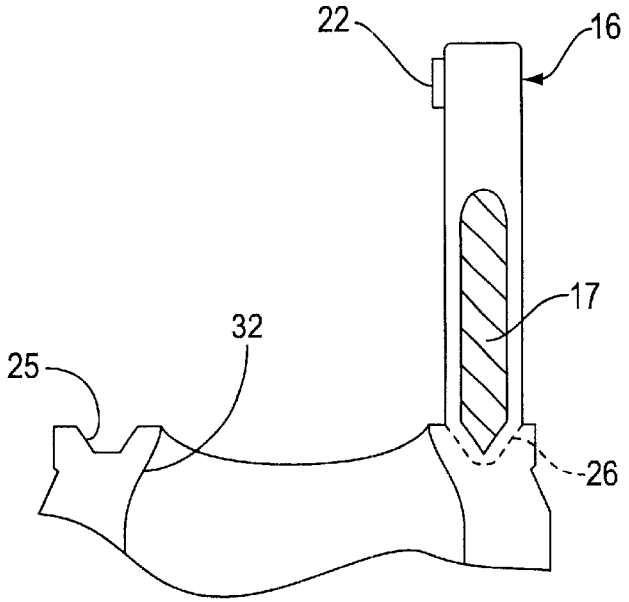
FIG. 5 is a cross-sectional detail view, partially broken away, of a spark plug shell in accordance with the invention, after welding of the ground electrode thereto.
Figure 6:
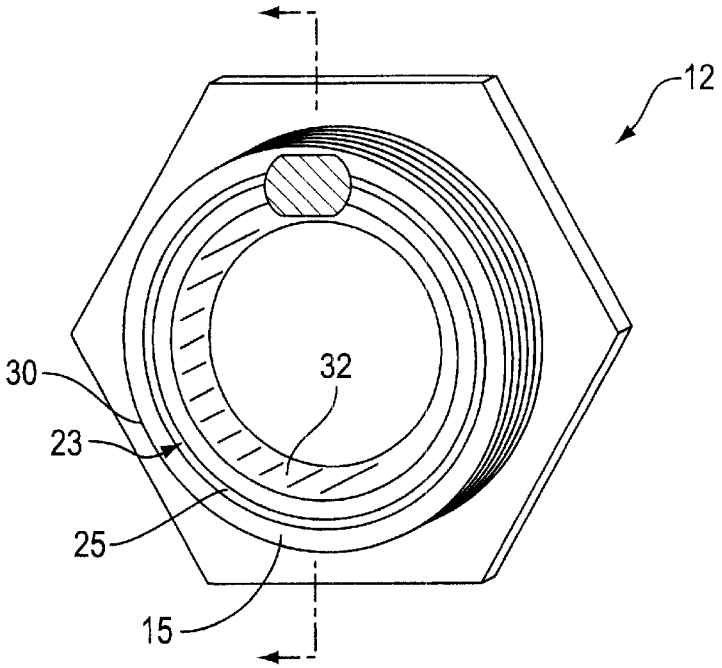
FIG. 6 is a perspective view of a spark plug shell according to the invention, with a ground electrode thereof shown cut away for purposes of illustration.

While the ground electrode 16 is shown in FIGS. 2, 4 and 5 oriented in a substantially straight or linear configuration thereof, and is attached to the shell 12 in a linear configuration during the manufacturing process, those in the art will realize and understand that after attachment of the ground electrode 16 to the spark plug shell, it will be bent substantially in a right angle configuration, and will then have a configuration substantially as shown in FIG. 1.

Optional Wear-resistant Electrode Tips

Optionally, the spark plug 10 according to the invention may also include first and/or second wear-resistant electrode tips 22, 24 which are attached to the ground and/or to the center electrodes 16, 20 respectively. Where used, each of the wear-resistant electrode tips 20, 22 is preferably formed from a material which includes a noble metal such as platinum, iridium, or alloys thereof. One alloy suitable for electrode tips is 85–95% platinum and 5–15% nickel. Examples of suitable wear-resistant spark plug tips may be found in U.S. Pat. Nos. 4,810,220 and 5,456,624, the disclosures of which are hereby incorporated by reference. In the event that only a single wear-resistant electrode tip is used in the practice of the present invention, it is preferred to be a fine wire tip attached to the center electrode 20 as taught by the disclosure of U.S. Pat. No. 5,456,624.

The Spark Plus Shell

Referring in particular to FIGS. 2 and 4–6, it may be seen that the spark plug shell 12 is a substantially cylindrical sleeve having a hollow bore 32 formed therethrough. As previously noted, the spark plug shell 12 includes a cylindrical base portion 14 which generally has threads formed on the exterior surface thereof. The spark plug shell 12 includes a sealing surface 34 for contacting a cylinder head (not shown), and also includes a generally hexagonal boss 36 thereon, above the sealing surface, to allow for grasping and turning thereof using a suitable tool, such as a conventional spark plug socket. In a spark plug shell 12 according to the present invention, the lower surface 15 thereof, rather than being entirely flat, has a recess 23 formed therein. This recess 23 is located approximately midway between the outer edge 30 of the lower surface 15 and the central bore 32 of the spark plug shell. The recess 23 is provided to aid in alignment of the tip end 27 of the ground electrode 16 with the shell 12.

Figure 3:
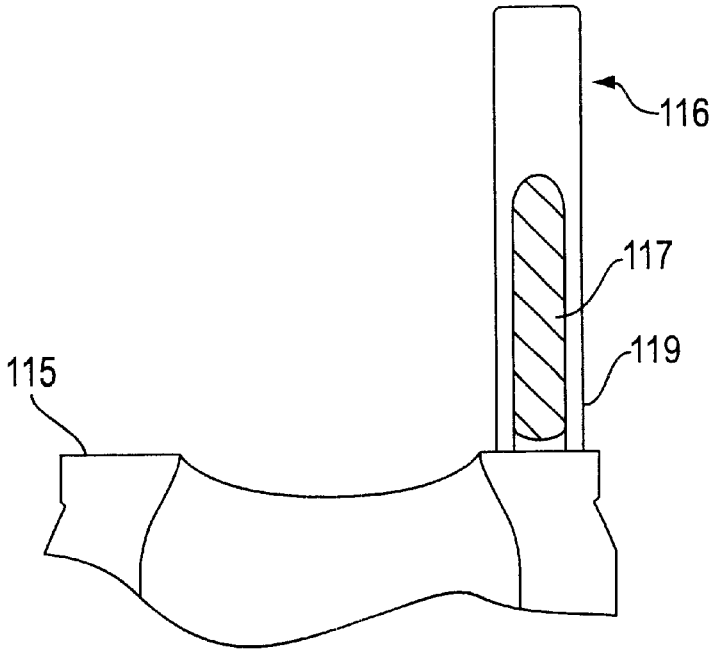
FIG. 3 (PRIOR ART)
FIG. 3 is a comparative cross-sectional detail view, partially broken away, of a prior art spark plug shell and electrode therefor, before attachment of the electrode to the shell.

As may be seen from a comparison of FIGS. 3 and 4, the provision of the recess 23 also provides greater surface contact area between the sheath 19 and the shell 12 than would be possible without the recess 23, to promote improved adhesion therebetween when the ground electrode 16 is welded on to the shell 12. A superior bonding zone 26 between the ground electrode 16 and the shell base 14 is suggested by the dashed line in FIG. 5, after these two components have been joined together.

In the most preferred embodiment of the present invention, the recess 23 is provided in the form of an annular groove 25 extending substantially continuously and concentrically around the lower surface 15 of the shell 12. The provision of the recess 23 in the form of an annular groove 25 around the full circumference of the lower surface 15 of the spark plug shell 12, rather than having the recess 23 simply take the form of a cavity formed in a single spot, eliminates any necessity of rotating the spark plug shell 12 to position it in a preferred orientation thereof during spark plug manufacture. The provision of the annular groove 25 further acts to minimize welding flash projections moving into the shell bore 32, or on to the threaded exterior surface of the shell base 14.

As seen in FIGS. 2 and 4, when the ground electrode 16 is formed, and before it is attached to the shell 12, the tip end 27 of the ground electrode includes a reduced diameter portion 28, which substantially forms a point thereon. This reduced diameter portion 28 fits into the recess 23 of the shell 12 and helps to promote alignment of the ground electrode 16 therewith.

Method of Making a Spark Plug

The present invention also contemplates a method of making a spark plug of the type described herein. In practicing the method according to the invention, a first step involves providing a metal spark plug shell 12 with a cylindrical base portion 14, in which the base portion includes a lower surface 15 with a recess 23 formed therein. The method also includes a step of providing a ground electrode 16 having a central core 17 formed from a thermally conductive material. The thermally conductive material used is a first metal as previously discussed herein, and may include copper.

The method also includes a further step of placing a tip end 27 of the ground electrode 16 adjacent the lower surface 15 of the shell 12 and aligned with the recess 23 thereof (FIG. 4), such that part of the tip end 27 of the ground electrode enters into the recess.

Another step in the method involves welding the ground electrode 16 on to the spark plug shell 12. The welding may be accomplished by electrical resistance welding, by laser welding, or by other known welding process.

A complete spark plug 10 may then be formed, following the known process for the remaining steps, using the shell 12 as a component thereof.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

We claim:

1. A method of making a spark plug, comprising the steps of:

a) providing a metal shell with a cylindrical base portion having a lower surface with a recess formed therein;

b) providing a ground electrode having a central core formed from a thermally conductive metal;

c) placing an end of the ground electrode adjacent the lower surface of the shell and aligned with the recess thereof, such that part of a tip end of the ground electrode enters the recess; and d) welding the ground electrode to the shell.

2. The method of claim 1, wherein the tip end of the ground electrode substantially forms a reduced diameter section which fits into the shell recess.

3. The method of claim 1, wherein the recess is provided as an annular grove extending around the lower surface of the shell.

4. The method of claim 3, wherein the annular groove extends substantially continuously around the shell lower surface.

5. A spark plug which is a product of the method of claim 1.

6. A spark plug which is a product of the method of claim 2.

* * * * *